US009885175B1

(12) United States Patent
Izumi et al.

(10) Patent No.: US 9,885,175 B1
(45) Date of Patent: Feb. 6, 2018

(54) VIBRATION DAMPER DEVICE AND LOAD-BEARING WALL STRUCTURE

(71) Applicant: MITSUI HOME CO., LTD., Tokyo (JP)

(72) Inventors: Junichi Izumi, Tokyo (JP); Kazuma Matsuo, Tokyo (JP)

(73) Assignee: MITSUI HOME CO., LTD. (JP)

( * ) Notice: Subject to any disclaimer, the term of this patent is extended or adjusted under 35 U.S.C. 154(b) by 0 days.

(21) Appl. No.: 15/408,038

(22) Filed: Jan. 17, 2017

(30) Foreign Application Priority Data

Oct. 14, 2016 (JP) ..... 2016-202223

(51) Int. Cl.
*E04B 1/98* (2006.01)
*E04H 9/02* (2006.01)
*E04B 1/26* (2006.01)

(52) U.S. Cl.
CPC ..... *E04B 1/98* (2013.01); *E04B 1/26* (2013.01); *E04H 9/021* (2013.01); *E04B 2001/2696* (2013.01)

(58) Field of Classification Search
CPC ..... E04B 1/98; E04B 1/26; E04B 2001/2696; E04B 2001/2496; E04H 9/021; E04H 9/028; E04H 9/02; E04H 9/024
See application file for complete search history.

(56) References Cited

U.S. PATENT DOCUMENTS

2005/0005561 A1* 1/2005 Hanson ..... E04B 1/24 52/633
2007/0028542 A1* 2/2007 Lafferty, III ..... E04B 1/26 52/293.3
2008/0016793 A1* 1/2008 Majlessi ..... E04B 1/24 52/167.3
2012/0038091 A1* 2/2012 Tagawa ..... E04H 9/021 267/136
2017/0058514 A1* 3/2017 Wu ..... E04H 9/021
2017/0138043 A1* 5/2017 Pryor ..... E04B 1/98
2017/0145686 A1* 5/2017 Lee ..... E04H 9/021

FOREIGN PATENT DOCUMENTS

JP 2014148859 * 2/2014 ..... E04H 9/02
JP 5830477 B2 10/2015

* cited by examiner

*Primary Examiner* — Brian D Mattei
(74) *Attorney, Agent, or Firm* — Steven M. Greenberg; CRGO Law

(57) ABSTRACT

A vibration damper device includes a pair of viscoelastic dampers, lower braces which support the viscoelastic dampers from below, upper braces which support the viscoelastic dampers from above, lower connection members which connect the viscoelastic dampers to the lower braces, upper connection members which connect the viscoelastic dampers to the upper braces, and first joining members and second joining members which join the pair of viscoelastic dampers. Each lower brace includes a lower recess which avoids interference with the central vertical frame, and a lower slit into which the lower connection member is inserted. Each upper brace includes an upper recess which avoids interference with the central vertical frame, and an upper slit into which the upper connection member is inserted.

7 Claims, 10 Drawing Sheets

VIBRATION DAMPER DEVICE AND LOAD-BEARING WALL STRUCTURE

BACKGROUND OF THE INVENTION

1. Field of the Invention

The present invention relates to a vibration damper device and a load-bearing wall structure provided with the vibration damper device.

2. Description of the Related Art

An invention to dispose a vibration damper device inside a wall framework is disclosed in Japanese Patent No. 5830477 (Patent Document 1), for example.

The wall framework of Patent Document 1 is constructed by erecting three vertical frames at regular intervals between a lower frame and an upper frame. The vibration damper device of Patent Document 1 includes: a pair of viscoelastic dampers disposed while sandwiching the vertical frame located in the center (hereinafter referred to as a "central vertical frame"); a pair of lower braces supporting the viscoelastic dampers from below; a pair of upper braces supporting the viscoelastic dampers from above; and joining members each penetrating the central vertical frame in a wall width direction and joining the pair of viscoelastic dampers to each other.

Each lower brace is inclined to come closer to the central vertical frame while extending from the lower frame to the viscoelastic damper. Each upper brace is inclined to come closer to the central vertical frame while extending from the upper frame to the viscoelastic damper. Each brace has constant cross-sectional dimensions throughout its length.

According to the invention of Patent Document 1, when seismic vibration is transmitted to a building whereby the wall framework is deformed into a parallelogram, seismic force (vibration energy) acting on the wall framework is transmitted to the viscoelastic dampers via the upper and lower braces. At this time, the viscoelastic dampers causes shear deformations in a horizontal direction, whereby the vibration energy that acts on the wall framework can be transformed into thermal energy and then absorbed.

In the meantime, the larger the inclination angle of each brace with respect to the central vertical frame, i.e., the closer an end on the central vertical frame side of the brace to the central vertical frame, the higher the stability of the brace. Hence, the seismic force acting on the wall framework can be reliably transmitted to the viscoelastic dampers. Nonetheless, there is only a small space for disposing the viscoelastic dampers. Accordingly, if the end on the central vertical frame side of each brace is inclined to come closer to the central vertical frame in the invention according to Patent Document 1, the brace interferes with the central vertical frame when inclined at a relatively small angle. Thus, it is difficult to incline each brace at a desired angle.

SUMMARY OF THE INVENTION

The present invention has been made in this point of view and has an object to provide a vibration damper device which can arrange braces each at a larger inclination angle with respect to a central vertical frame than those in conventional structures, and to provide a load-bearing wall structure including the vibration damper device.

In order to solve the problem described above, the present invention is a vibration damper device to be disposed in a wall framework including a lower frame, a pair of end vertical frames erected on ends of the lower frame, an upper frame laid across upper ends of the pair of end vertical frames, and a central vertical frame disposed between the pair of end vertical frames and extending from the lower frame to the upper frame, the vibration damper device including: a pair of viscoelastic dampers arranged while sandwiching the central vertical frame; a pair of lower braces supporting the viscoelastic dampers from below, and being inclined to come closer to the central vertical frame while extending toward the viscoelastic dampers; a pair of upper braces supporting the viscoelastic dampers from above, and being inclined to come closer to the central vertical frame while extending toward the viscoelastic dampers; multiple connection members connecting the viscoelastic dampers to the lower braces and to the upper braces; and a joining member inserted into a through-hole penetrating the central vertical frame in a wall width direction, and configured to join the pair of viscoelastic dampers. Each of the lower braces and the upper braces includes a recess formed at an end on the central vertical frame side of the brace so as to avoid interference with the central vertical frame, and a slit into which the corresponding connection member is inserted.

According to the present invention, each of the lower braces and the upper braces includes the recess which is formed by cutting out the end on the central vertical frame side of the brace so as to avoid interference with the central vertical frame. Thus, it is possible to bring the ends on the central vertical frame side of the respective braces closer to the central vertical frame as compared to the braces of Patent Document 1 each of which has the constant cross-sectional dimensions throughout its length. In this way, each brace can be arranged at a larger inclination angle with respect to the central vertical frame. As a consequence, stability of each brace is increased so that seismic force acting on the wall framework can be reliably transmitted to the viscoelastic dampers. In addition, according to the present invention, each of the lower braces and the upper braces includes a slit into which the corresponding connection member is inserted. Accordingly, interlock between the braces and the connection members is enhanced. As a consequence, the seismic force acting on the wall framework can be smoothly transmitted from the braces to the viscoelastic dampers even in the case of providing the recess.

It is preferable that each of the lower braces and the upper braces be formed into a hollow shape including a pair of side walls opposed to each other in the wall width direction, and the slit be formed in each of the side walls and hold two sides in the wall width direction of the connection member.

In this way, the two sides in the wall width direction of each connection member are held in the slits. Accordingly, interlock between each brace and the corresponding connection member is further enhanced. As a consequence, the seismic force can be smoothly transmitted from the braces to the viscoelastic dampers.

It is preferable that each of the lower braces and the upper braces be formed into a flat hollow shape which is longer in the wall width direction than in a wall thickness direction.

In this way, each brace is formed into the flat hollow shape, which is longer in the wall width direction than in the wall thickness direction. This configuration enhances strength and rigidity of each brace in the wall width direction which is a direction of action of the seismic force. As a consequence, the seismic force can be smoothly transmitted from each brace to the corresponding viscoelastic damper.

It is preferable that the vibration damper device include: base plates interposed between the lower frame and the lower braces and between the upper frame and the upper braces; and connection members each of which extends upward or downward from the corresponding base plate, and is connected to the central vertical frame side of the corresponding one of the lower braces and the upper braces.

In this way, each connection member can control an angular variation between the base plate and the brace, and the seismic force can be reliably transmitted to the corresponding viscoelastic damper. As a consequence, it is possible to increase an amount of shear deformation of each viscoelastic damper and thus to increase an amount of absorption of the seismic force.

In order to solve the problem described above, the present invention is a load-bearing wall structure including: the vibration damper device according to claim 4; and a constructional material disposed above the upper frame or below the lower frame. Each of the base plates is fixed to the constructional material and to the upper frame or the lower frame by using a coach screw bolt inserted from below the upper frame or from above the lower frame.

According to the present invention, when the vibration damper device of the present invention is attached to a wall on a lower floor (such as a first floor), an operation to attach the base plates to the upper frame and the constructional material can take place on the wall on the lower floor. As a consequence, the installation operation can be conducted without destroying the members on an upper floor (such as a second floor) side, and installation workability is thus enhanced. Moreover, according to the present invention, when the vibration damper device of the present invention is attached to a wall on the upper floor (such as the second floor), an operation to attach the base plates to the lower frame and the constructional material can take place on the wall on the upper floor. As a consequence, the installation operation can be conducted without destroying the members on the lower floor (such as the first floor) side, and installation workability is thus enhanced.

In order to solve the problem described above, the present invention is a load-bearing wall structure including: the vibration damper device according to any one of claims 1 to 4; a base including a base upright portion; a lower constructional material disposed on an upper face of the base upright portion; a board plate laid over the lower constructional material from above, and extending across two sides of the base upright portion; and the lower frame disposed above the lower constructional material and the board plate. The base upright portion and the board plate are connected to each other by a fixation member driven in from a lateral side of the base upright portion, and an anchor unit vertically penetrating the lower frame is provided on an upper wall of the board plate.

According to the present invention, it is possible to drive in the fixation member while avoiding interference with a main reinforcement that is located at a relatively shallow position from an upper face of the base upright portion. Thus, it is possible to counter tensile force with a shear capacity of the fixation member. In addition, it is also possible to increase the shear capacity by increasing the number of the fixation members. Meanwhile, according to the present invention, it is only necessary to put the board plate in a portal shape and provided with the anchor unit on the lower constructional material from above. Accordingly, this configuration suppresses the cutting work on the lower constructional material and facilitates the installation operation.

According to the vibration damper device and the load-bearing wall structure of the present invention, each brace can be arranged at a larger inclination angle with respect to a central vertical frame as compared to the related art.

DETAILED DESCRIPTION OF THE EMBODIMENTS

An embodiment of the present invention will be described in detail with reference to the accompanying drawings. In the description, the same constituents are denoted by the same reference signs and overlapping explanations will be omitted.

Figure 1:
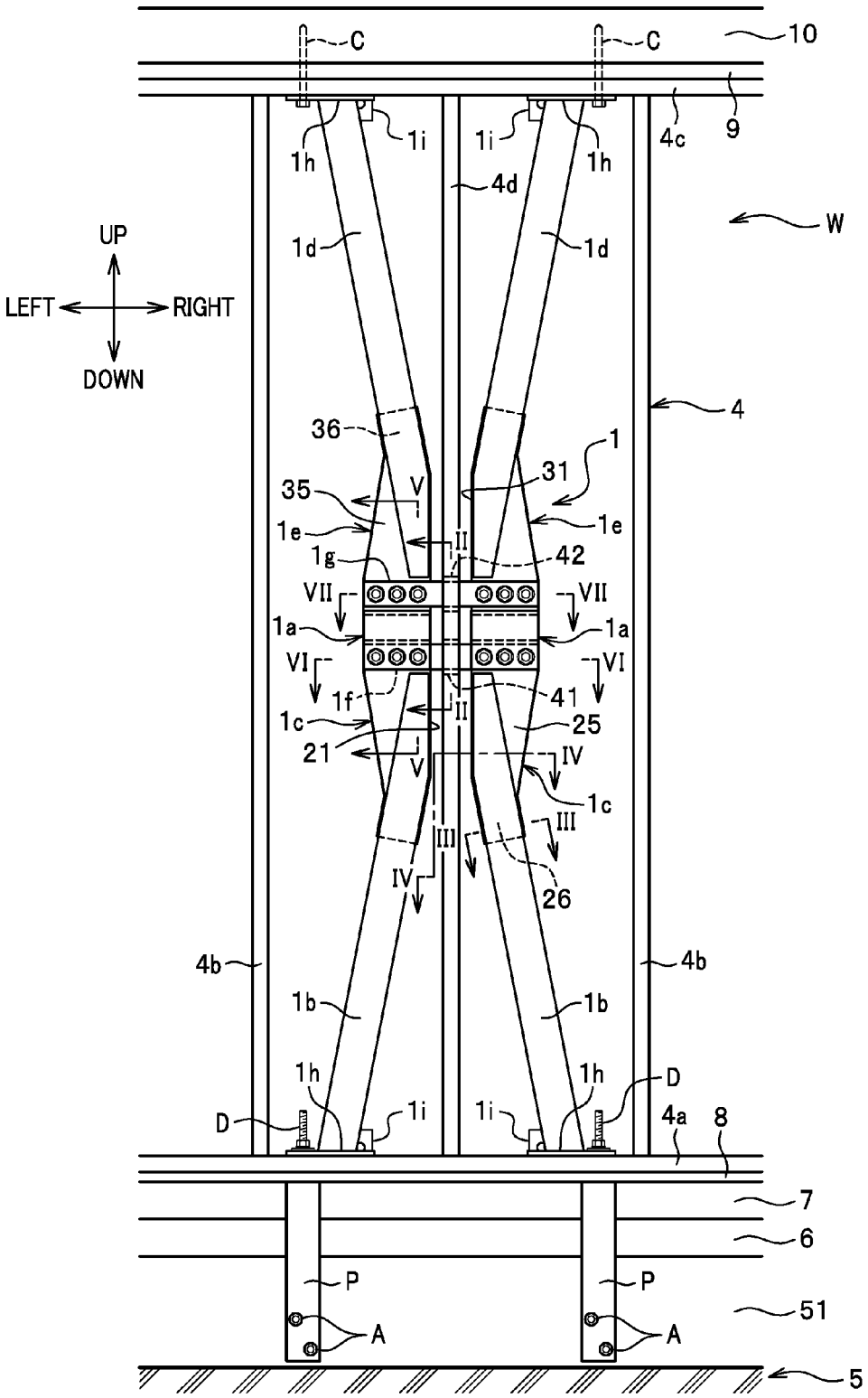
FIG. 1 is a front view showing a load-bearing wall structure according to an embodiment of the present invention.

As shown in FIG. 1, a load-bearing wall structure W according to the embodiment of the present invention includes a base 5, a foundation 6 disposed on an upper face of the base 5, floor joists 7 disposed on an upper face of the foundation 6, and a floor structure plywood plate 8 disposed on upper faces of the floor joists 7. Moreover, the load-bearing wall structure W includes a wall framework 4 disposed on an upper face of the floor structure plywood plate 8, a vibration damper device 1 disposed inside the wall framework 4, a top plate 9 disposed on an upper face of the wall framework 4, and a floor beam 10 disposed on an upper face of the top plate 9. Note that although this embodiment explains an example of applying the load-bearing wall structure of the present invention to a wood building constructed in accordance with a framing method, the embodiment does not aim to limit the intended use of the present invention. In the following description, a height direction of the load-bearing wall structure may be referred to as a vertical direction and a wall width direction of the load-bearing wall structure may be referred to as a right-left direction as appropriate.

The wall framework 4 includes a lower frame 4*a* extending in the right-left direction, a pair of end vertical frames 4*b* erected on right and left ends of the lower frame 4*a*, an upper frame 4*c* laid across upper ends of the pair of end vertical frames 4*b*, and a central vertical frame 4*d* disposed between the pair of end vertical frames 4*b* and extending from the lower frame 4*a* to the upper frame 4*c*. The wall framework 4 has two vertically long rectangular spaces on two sides of the central vertical frame 4*d*. Each of these frames 4*a* to 4*d* is formed from a square timber.

The lower frame 4*a* is disposed on the upper face of the floor structure plywood plate 8. A 2×4 material (38 mm×89 mm) is used for the lower frame 4*a* in this embodiment.

The pair of end vertical frames 4*b* are opposed to the central vertical frame 4*d* at equal intervals, respectively. Such an interval is set to 455 mm, for instance, which represents a typical column interval in the framing method. The pair of end vertical frames 4*b* extend parallel to each other. A 2×4 material is used for each end vertical frame 4*b* in this embodiment.

The upper frame 4*c* is disposed below a lower face of the top plate 9. A 2×4 material is used for the upper frame 4*c* in this embodiment.

Figure 2:
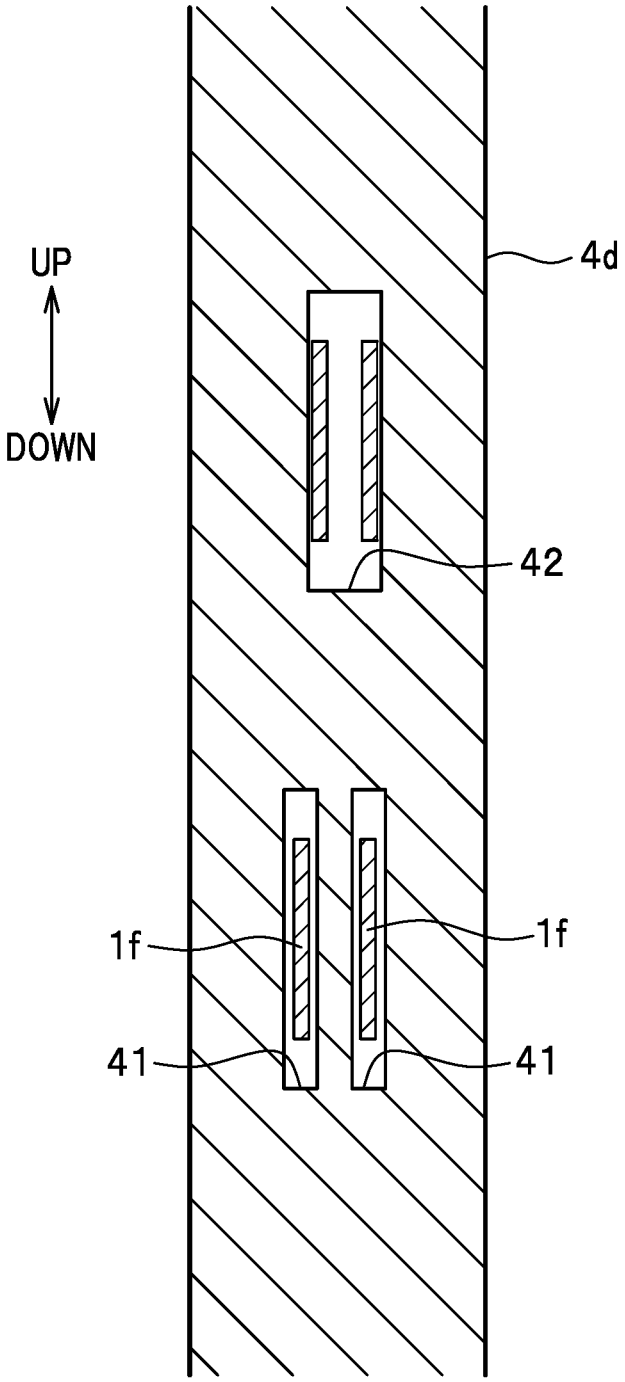
FIG. 2 is a cross-sectional view taken along the II-II line in FIG. 1.

The central vertical frame 4*d* extends parallel to the end vertical frames 4*b*. A 2×4 material is used for the central vertical frame 4*d* in this embodiment. First through-holes 41 and a second through-hole 42 are formed to penetrate in the right-left direction at central parts in the vertical direction of the central vertical frame 4*d*, respectively. As shown in FIG. 2, the first through-holes 41 and the second through-hole 42 are arranged at an interval in the vertical direction. As for the first through-holes 41 located on a lower side, multiple (two in this embodiment) through-holes are formed at an interval in a wall thickness direction. The second through-hole 42 located on an upper side is formed of a single through-hole. Here, the locations of the first through-holes 41 and the second through-hole 42 may be vertically inverted.

As shown in FIG. 1, the vibration damper device 1 includes a pair of viscoelastic dampers 1*a*, a pair of lower braces 1*b*, a pair of lower connection members 1*c*, a pair of upper braces 1*d*, a pair of upper connection members 1*e*, first joining members 1*f*, second joining members 1*g*, multiple base plates 1*h*, and multiple rib plates 1*i*.

The lower braces 1*b* are members to support the viscoelastic dampers 1*a* from below. The lower braces 1*b* are inclined to come closer to the central vertical frame 4*d* while extending from ends in the right-left direction of the lower frame 4*a* toward the viscoelastic dampers 1*a*, respectively. The pair of lower braces 1*b* are arranged in an inverted V-shape while sandwiching the central vertical frame 4*d*.

A lower recess 21 for avoiding interference with the central vertical frame 4*d* is formed by cutting out an end (an upper end) of each lower brace 1*b* adjacent to the central vertical frame 4*d*. The lower recess 21 is linearly cut out along the central vertical frame 4*d*. In other words, the lower recess 21 of this embodiment extends vertically and in parallel to the central vertical frame 4*d*. However, the shape of the lower recess 21 is not limited to a particular shape. For example, the lower recess 21 may be formed by being cut out into an arc shape that recedes from the central vertical frame 4*d*.

Figure 3:
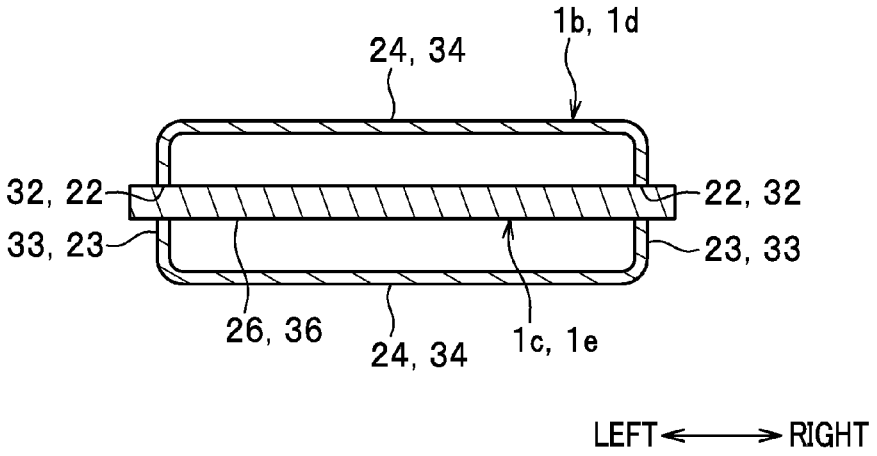
FIG. 3 is a cross-sectional view taken along the III-III line in FIG. 1.

As shown in FIG. 3, each lower brace 1*b* is made of a steel pipe having a shape of a rectangular tube. The lower brace 1*b* is formed into a flat hollow shape which is longer in the wall width direction (the right-left direction) than in the wall thickness direction. The lower brace 1*b* includes a pair of narrow-width side walls 23 opposed to each other in the wall width direction, and a pair of wide-width side walls 24 opposed to each other in the wall thickness direction.

Figure 4:
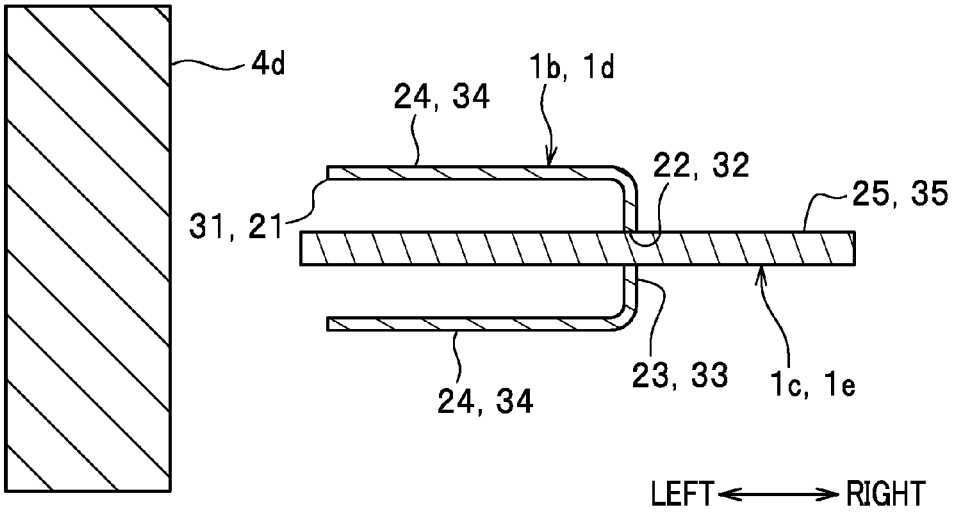
FIG. 4 is a cross-sectional view taken along the IV-IV line in FIG. 1.

As shown in FIGS. 3 and 4, lower slits 22 into which the lower connection member 1*c* is inserted (held) are formed on an upper end side of the lower brace 1*b*. The lower slits 22 penetrate the narrow-width side walls 23 in the right-left direction, and establish communication between the inside and the outside of lower brace 1*b*. Here, the lower recess 21 is formed by cutting out the entire narrow-width side wall 23 located closest to the central vertical frame 4*d* and part of each wide-width side wall 24.

As shown in FIG. 1, the lower connection members 1*c* are members to connect the viscoelastic dampers 1*a* to the lower braces 1*b*. Each lower connection member 1*c* is made of a metal plate. The lower connection member 1*c* includes a base end plate portion 25 extending downward from the corresponding viscoelastic damper 1*a*, and a front end plate portion 26 inclined outward from a lower end of the base end plate portion 25.

The base end plate portion 25 is inserted to the lower recess 21 side of the inside of the lower brace 1*b*. As shown in FIG. 4, a central part in the wall width direction of the base end plate portion 25 is inserted into (held in) the lower slit 22 of the narrow-width side wall 23 located farthest from the central vertical frame 4*d*. The outside in the wall width direction of the base end plate portion 25 is exposed to the outside of the lower brace 1*b* via the lower slit 22.

As shown in FIG. 1, the front end plate portion 26 is inserted to the inside of the lower brace 1*b* in a region below the lower recess 21. Inclination angles of the front end plate portion 26 and of the lower brace 1*b* are equal. As shown in FIG. 3, two sides in the wall width direction of the front end plate portion 26 are inserted into (held in) the lower slits 22 in the two narrow-width side walls 23. Although illustration is omitted, a boundary region between each lower slit 22 and the lower connection member 1*c* is provided with welding, and the lower brace 1*b* and the lower connection member 1*c* are thus fixed to each other.

As shown in FIG. 1, the upper braces 1*d* are members to support the viscoelastic dampers 1*a* from above. The upper braces 1*d* are inclined to come closer to the central vertical frame 4*d* while extending from ends in the right-left direction of the upper frame 4*c* toward the viscoelastic dampers 1*a*, respectively. The pair of upper braces 1*d* are arranged in a V-shape while sandwiching the central vertical frame 4*d*. Note that since the upper braces 1*d* and the lower braces 1*b* are vertically symmetrically arranged, the upper braces 1*d* will be described below with reference to FIGS. 3 and 4 representing the cross-sectional views of the lower brace 1*b* as appropriate.

An upper recess 31 for avoiding interference with the central vertical frame 4*d* is formed by cutting out an end (a lower end) of each upper brace 1*d* adjacent to the central vertical frame 4*d*. The upper recess 31 is linearly cut out along the central vertical frame 4*d*. In other words, the upper recess 31 of this embodiment extends vertically and in parallel to the central vertical frame 4*d*. However, the shape of the upper recess 31 is not limited to a particular shape. For example, the upper recess 31 may be formed by being cut out into an arc shape that recedes from the central vertical frame 4*d*.

As shown in FIG. 3, each upper brace 1*d* is made of a steel pipe having a shape of a rectangular tube. The upper brace 1*d* is formed into a flat hollow shape which is longer in the wall width direction than in the wall thickness direction. The upper brace 1*d* includes a pair of narrow-width side walls 33 opposed to each other in the wall width direction, and a pair of wide-width side walls 34 opposed to each other in the wall thickness direction.

As shown in FIGS. 3 and 4, upper slits 32 into which the upper connection member 1*e* is inserted (held) are formed on a lower end side of the upper brace 1*d*. The upper slits 32 penetrate the narrow-width side walls 33 in the right-left direction, and establish communication between the inside and the outside of upper brace 1*d*. Here, the upper recess 31 is formed by cutting out the entire narrow-width side wall 33 located closest to the central vertical frame 4*d* and part of each wide-width side wall 34.

As shown in FIG. 1, the upper connection members 1*e* are members to connect the viscoelastic dampers 1*a* to the upper braces 1*d*. Each upper connection member 1*e* is made of a metal plate. The upper connection member 1*e* includes a base end plate portion 35 extending upward from the corresponding viscoelastic damper 1*a*, and a front end plate portion 36 inclined outward from an upper end of the base end plate portion 35. Note that since the upper connection members 1*e* and the lower connection members 1*c* are vertically symmetrically arranged, the upper connection members 1*e* will be described below with reference to FIGS. 3 and 4 representing the cross-sectional views of the lower connection members 1*c* as appropriate.

The base end plate portion 35 is inserted to the upper recess 31 side of the inside of the upper brace 1*d*. As shown in FIG. 4, a central part in the wall width direction of the base end plate portion 35 is inserted into (held in) the upper slit 32 of the narrow-width side wall 33 located farthest from the central vertical frame 4*d*. The outside in the wall width direction of the base end plate portion 35 is exposed to the outside of the upper brace 1*d* via the upper slit 32.

As shown in FIG. 1, the front end plate portion 36 is inserted to the inside of the upper brace 1*d* in a region above the upper recess 31. Inclination angles of the front end plate portion 36 and of the upper brace 1*d* are equal. As shown in FIG. 3, two sides in the wall width direction of the front end plate portion 36 are inserted into (held in) the upper slits 32 in the two narrow-width side walls 33. Although illustration is omitted, a boundary region between each upper slit 32 and the upper connection member 1*e* is provided with welding, and the upper brace 1*d* and the upper connection member 1*e* are thus fixed to each other.

Figure 5:
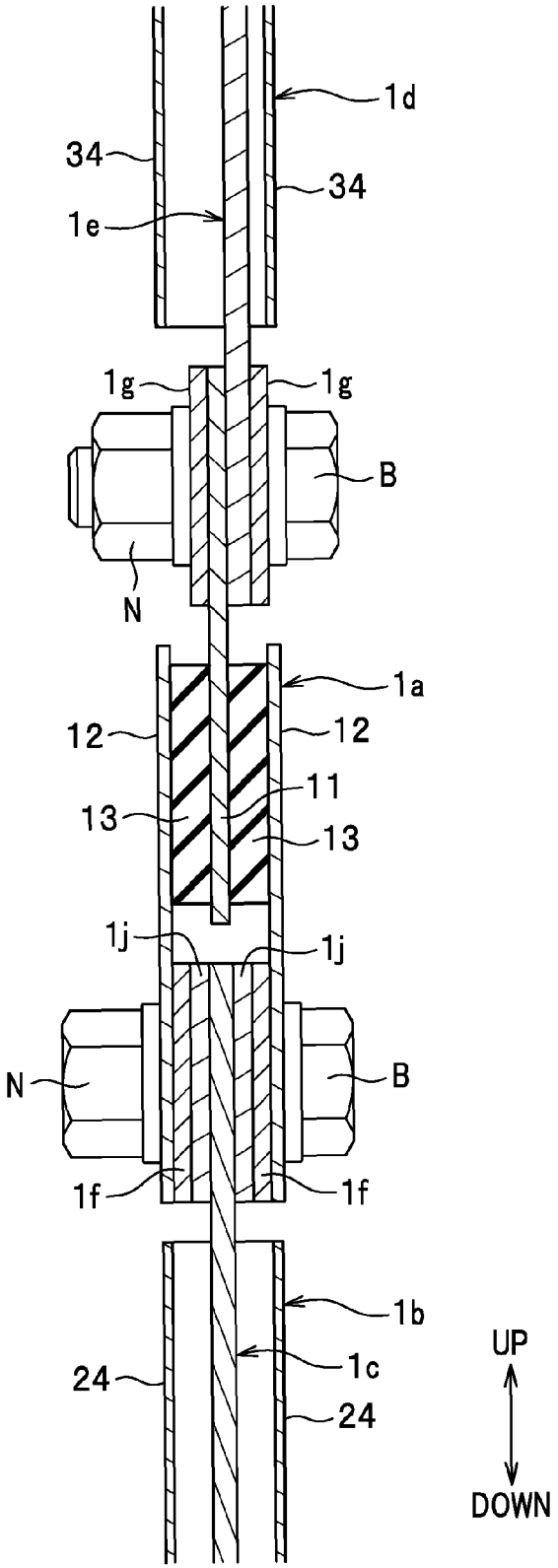
FIG. 5 is a cross-sectional view taken along the V-V line in FIG. 1.

As shown in FIG. 1, the viscoelastic dampers 1*a* are members which absorb vibration energy that acts on the wall framework 4, as a consequence of a deformation of the wall framework 4 into a parallelogram caused by seismic vibration. The pair of viscoelastic dampers 1*a* are arranged to sandwich the central vertical frame 4, and are located in the vicinity of a central part in the vertical direction of the wall framework 4. As shown in FIG. 5, each viscoelastic damper 1*a* includes a center plate 11, a pair of outer plates 12 opposed to each other while sandwiching the center plate 11, and a pair of viscoelastic bodies 13 each disposed between the center plate 11 and the corresponding one of the outer plates 12.

The center plate 11 is made of a rectangular metal plate. A lower end of the center plate 11 is located below a lower end of the upper connection member 1*e*. An upper end of the center plate 11 is fixed to the lower end of the upper connection member 1*e* together with the pair of second joining members 1*g*, and by using a bolt B and a nut N.

Each outer plate 12 is made of a rectangular metal plate. A lower end of the outer plate 12 is located below a lower end of the center plate 11. The lower ends of the pair of outer plates 12 are fixed to an upper end of the lower connection member 1*c* while sandwiching the pair of first joining members 1*f* and two filler plates 1*j*, and by using a bolt B and a nut N.

Each viscoelastic body 13 transforms the vibration energy acting on the wall framework 4 into thermal energy by means of a shear deformation in the right-left direction (a horizontal direction), and then absorbs the thermal energy. The viscoelastic body 13 is brought into surface contact with the lower end side of the center plate 11 and an upper end side of the corresponding outer plate 12. Here, the viscoelastic dampers 1*a* may be vertically inverted. Hence, the center plate 11 may be fixed to the lower connection member 1*c* and the outer plates 12 may be fixed to the upper connection member 1*e*.

Figure 6:
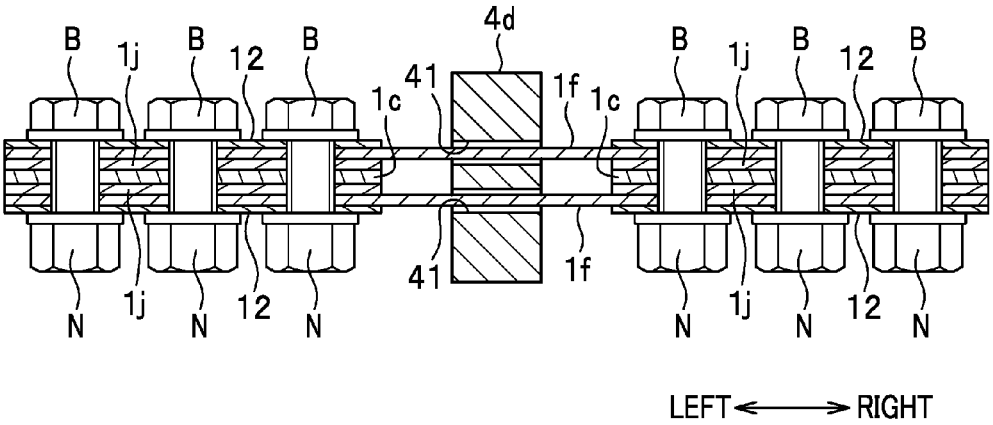
FIG. 6 is a cross-sectional view taken along the VI-VI line in FIG. 1.

As shown in FIG. 1, the first joining members 1*f* are members to join lower ends of the pair of viscoelastic dampers 1*a* to each other. Each first joining member 1*f* is made of a metal plate. The first joining member 1*f* has a rectangular shape which is elongated in the wall width direction. As shown in FIG. 6, each first joining member 1*f* is inserted into the corresponding first through-hole 41, and projects to spaces on the right and left of the central vertical frame 4*d* via the first through-hole 41. The two first joining members 1*f* are arranged while sandwiching the two filler plates 1*j* and the lower connection member 1*c*. Each outer plate 12 is disposed on the outside in the wall thickness direction of the corresponding first joining member 1*f*.

The regions of the first joining members 1*f* located in the space on the right side of the central vertical frame 4*d* are integrally fixed to the two outer plates 12, the two filler plates 1*j*, and the lower connection member 1*c* by using multiple (three in this embodiment) bolts B and nuts N. The bolts B and the nuts N are arranged at intervals in the wall width direction. Likewise, the regions of the first joining members 1*f* located in the space on the left side of the central vertical frame 4*d* are integrally fixed to the two outer plates 12, the two filler plates 1*j*, and the lower connection member 1*c* by using multiple (three in this embodiment) bolts B and nuts N. The bolts B and the nuts N are arranged at intervals in the wall width direction.

Figure 7:
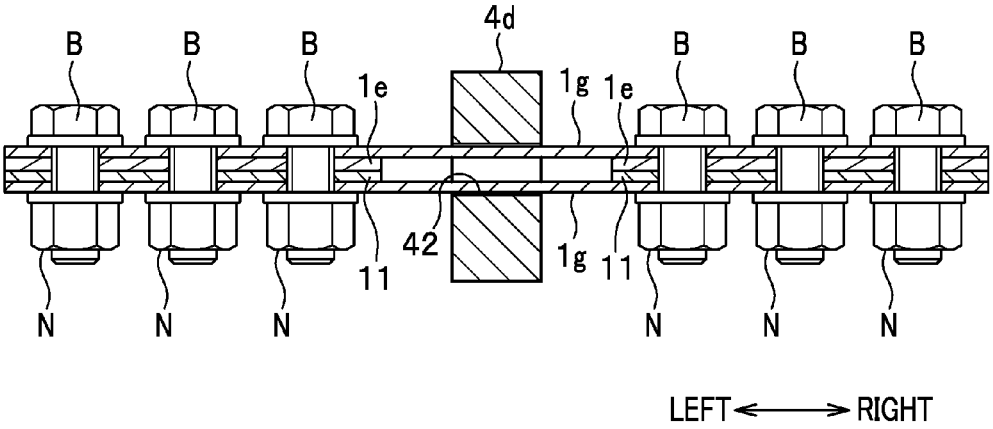
FIG. 7 is a cross-sectional view taken along the VII-VII line in FIG. 1.

As shown in FIG. 1, the second joining members 1*g* are members to join upper ends of the pair of viscoelastic dampers 1*a* to each other. Each second joining member 1*g* is made of a metal plate. The second joining member 1*g* has a rectangular shape which is elongated in the wall width direction. As shown in FIG. 7, the second joining members 1*g* are inserted into the second through-hole 42, and project to the spaces on the right and left of the central vertical frame 4*d* via the second through-hole 42. The two second joining members 1*g* are arranged while sandwiching the center plates 11 and the upper connection members 1*e*.

The regions of the second joining members 1*g* located in the space on the right side of the central vertical frame 4*d* are integrally fixed to the center plate 11 and the upper connection member 1*e* by using multiple (three in this embodiment) bolts B and nuts N. The bolts B and the nuts N are arranged at intervals in the wall width direction. Likewise, the regions of the second joining members 1*g* located in the space on the left side of the central vertical frame 4*d* are integrally fixed to the center plate 11 and the upper connection member 1*e* by using multiple (three in this embodiment) bolts B and nuts N. The bolts B and the nuts N are arranged at intervals in the wall width direction.

As shown in FIG. 1, the base plates 1*h* are members interposed between the lower frame 4*a* and the lower braces 1*b* as well as between the upper frame 4*c* and the upper braces 1*d*, respectively. Each base plate 1*h* is made of a metal plate. Each lower base plate 1*h* is fixed by welding to a lower end of the corresponding lower brace 1*b*, and is fixed by using a screw, a bolt, and the like to an upper face of the lower frame 4*a*. Each upper base plate 1*h* is fixed by welding to an upper end of the corresponding upper brace 1*d*, and is fixed by using a screw, a bolt, and the like to a lower face of the upper frame 4*c*.

Figure 8:
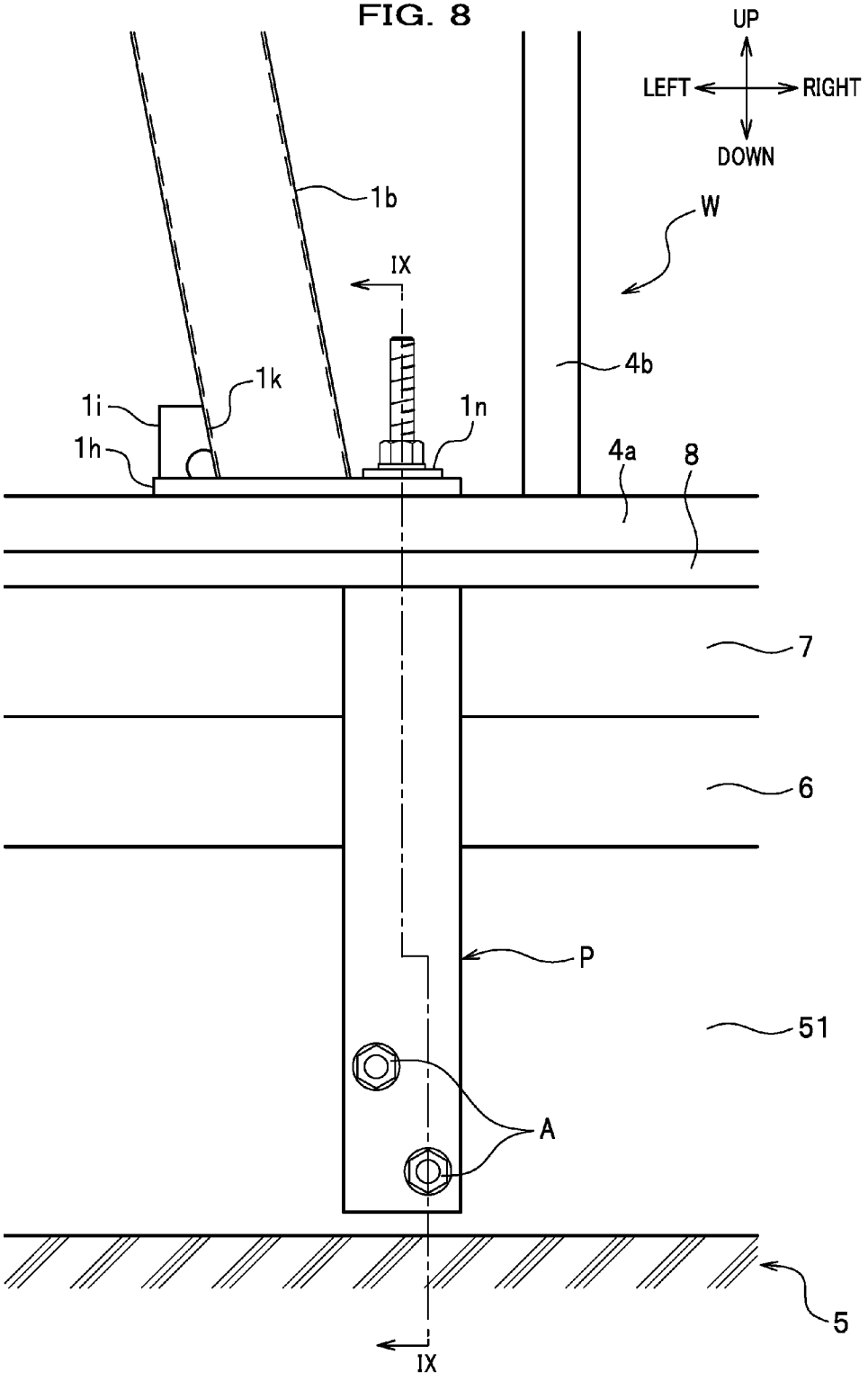
FIG. 8 is a partially enlarged front view showing a lower structure of the load-bearing wall structure.

The lower rib plates 1*i* are members which extend upward from the lower base plates 1*h* to the lower braces 1*b*, while the upper rib plates 1*i* are members which extend downward from the upper base plates 1*h* to the upper braces 1*d*. Each rib plate 1*i* of this embodiment is made of a metal plate provided separately from the base plate 1*h*. The rib plate 1*i* is fixed by welding onto the corresponding base plate 1*h*. Since the upper and lower rib plates 1*i* have the same configuration except the direction of extension from the base plate 1*h*, one of the lower rib plates 1*i* will be mainly described below with reference to FIG. 8.

The rib plate 1*i* is a connection member to be connected to the central vertical frame 4*d* (see FIG. 1) side of the lower brace 1*b*. The rib plate 1*i* has a function to control an angular variation between the base plate 1*h* and the lower brace 1*b*. The rib plate 1*i* has a contact face 1*k* to come into contact with the lower brace 1*b*. The contact face 1*k* extends (is inclined) parallel to the lower brace 1*b*. The contact face 1*k* is joined to the lower brace 1*b* by welding and the like.

Figure 9:
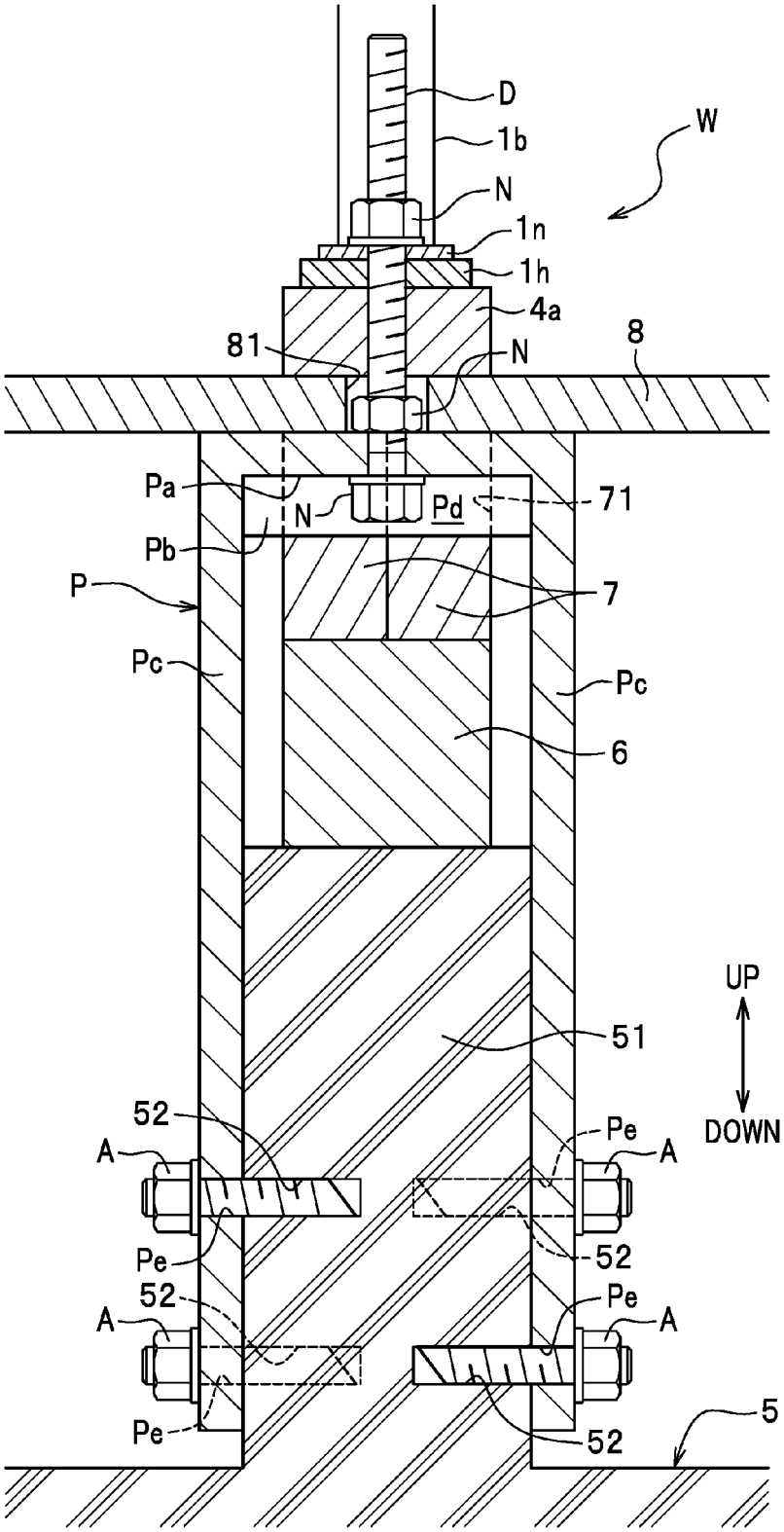
FIG. 9 is a cross-sectional view taken along the IX-IX line in FIG. 8.
Figure 10:
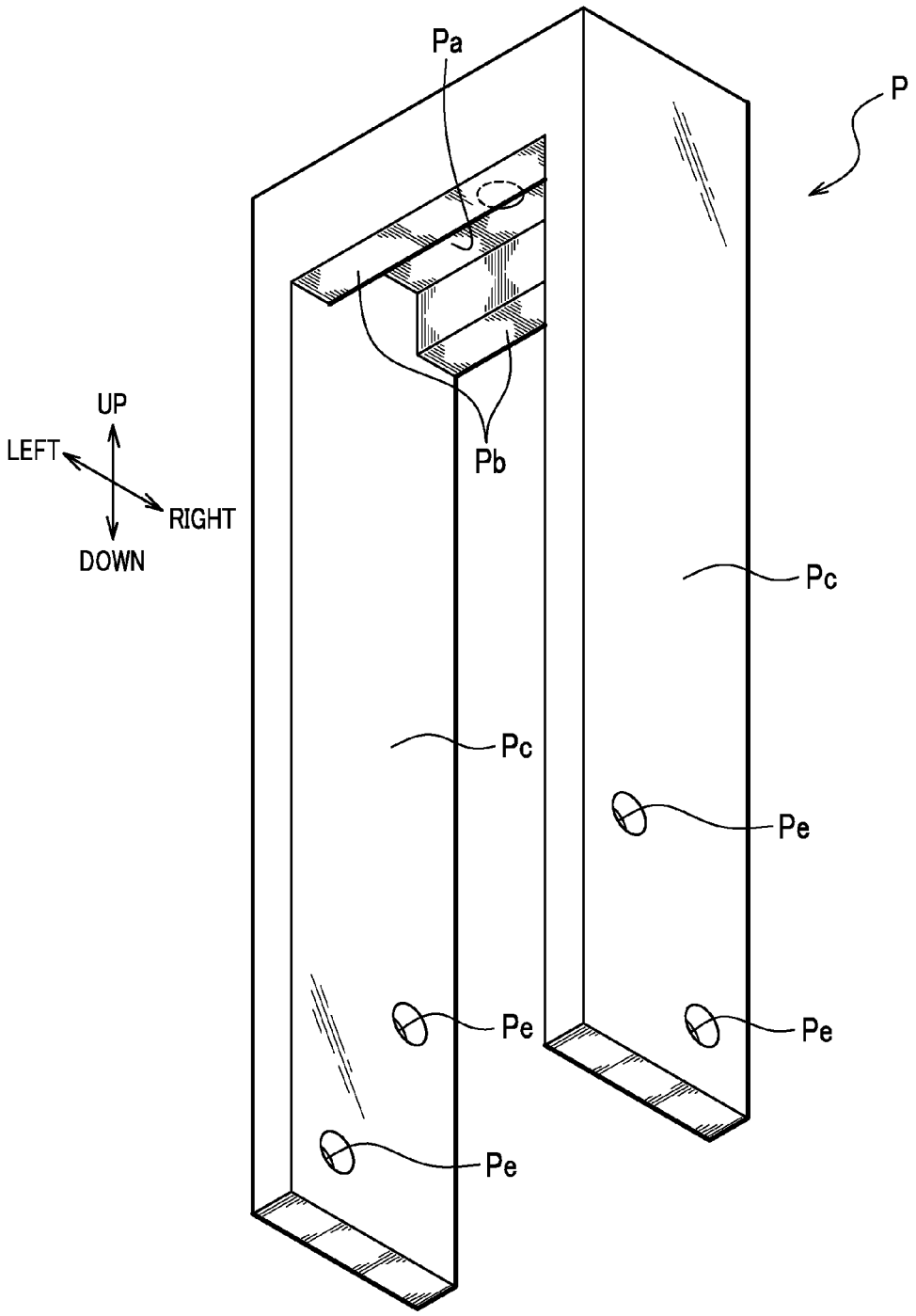
FIG. 10 is a perspective view showing a board plate of the embodiment.

Now, a lower structure of the load-bearing wall structure W including the lower base plate 1*h* will be described in detail with reference to FIGS. 9 and 10. Note that FIG. 10 illustrates a state of a board plate P viewed from obliquely below. As shown in FIG. 9, the lower structure of the load-bearing wall structure W is formed by disposing the base 5, the foundation 6, the floor joists 7, the board plate P, the floor structure plywood plate 8, the lower frame 4*a*, the base plate 1*h*, and a washer 1*n* sequentially in this order from below. The base 5 includes a base upright portion 51. Two floor joists 7 are arranged parallel in the horizontal direction on the foundation 6 in this embodiment. Recesses 71 that recede downward are formed in part of upper faces of the respective floor joists 7. The foundation 6 and the floor joists 7 collectively correspond to a lower constructional material in a claim of the invention. Here, a recess may be formed in part of an upper face of the foundation 6 while omitting the floor joists 7.

The board plate P is made of a metal plate having a portal shape. The board plate P is laid over the floor joists 7 from above, and extends across two sides of the base upright portion 51. As shown in FIG. 10, the board plate P includes an upper plate Pa, a pair of short side plates Pb hanging down from ends in the wall width direction of the upper plate Pa, and a pair of long side plates Pc hanging down from ends in the wall thickness direction of the upper plate Pa.

As shown in FIG. 9, the upper plate Pa is a region to be disposed inside the recesses 71 of the floor joists 7. An upper face of the upper plate Pa is flush with the upper faces of the floor joists 7. The upper plate Pa is provided with an anchor unit D in a vertically penetrating manner. The anchor unit D of this embodiment is formed from a bolt. The anchor unit D is fixed to the upper plate Pa by being threadedly engaged with nuts N on two sides above and below the upper plate Pa. A space Pd surrounded by the short side plates Pb and the long side plates Pc is defined below the upper plate Pa. The lower nut N is housed in the space Pd. The upper nut N is housed in a through-hole 81 that is drilled vertically in the floor structure plywood plate 8.

The anchor unit D vertically penetrates the floor structure plywood plate 8, the lower frame 4*a*, the base plate 1*h*, and the washer 1*n*. The anchor unit D projects to the inside of the wall framework 4 via a through-hole in the base plate 1*h* (see FIG. 8). The base plate 1*h* is fastened to the lower frame 4*a*, the floor structure plywood plate 8, and the board plate P by bringing the projecting part of the anchor unit D into threaded engagement with another nut N from above. Thus, the lower brace 1*b* is fastened to the lower frame 4*a*, the floor structure plywood plate 8, and the board plate P via the base plate 1*h*.

The short side plates Pb are regions to be disposed inside the recesses 71 of the floor joists 7. Lower faces of the short side plates Pb are in contact with bottom faces of the recesses 71.

The long side plates Pc are regions to be disposed on the side of the floor joists 7, the foundation 6, and the base upright portion 51. The long side plates Pc extend downward for a larger length than that of the short side plates Pb. Side faces of the long side plates Pc are in contact with side faces of the base upright portion 51.

The long side plates Pc and the base upright portion 51 are connected to one another by using multiple fixation members A driven in from the side of the base upright portion 51. The board plate P, the fixation members A, and the anchor unit D of the embodiment collectively constitute a post-installed anchor. Each of the long side plates Pc is provided with insertion through-holes Pe in a horizontally penetrating manner. In this embodiment, two insertion through-holes Pe are arranged at an interval in the vertical direction and an interval in the right-left direction in each of the long side plates Pc (i.e., four insertion through-holes Pe in total). The insertion through-holes Pe in one of the long side plates Pc are arranged symmetrical to the insertion through-holes Pe in the other long side plate Pc with respect to the vertical axis passing through the center of the long side plates Pc (see FIG. 10). Insertion through-holes 52 are formed in the base upright portion 51 at positions corresponding to the insertion through-holes Pe. In this embodiment, two fixation members A are driven in from the side of each of the long side plates Pc into the insertion through-holes Pe and 52 (i.e., four fixation members A in total). Each fixation member A of this embodiment is formed from a chemical anchor. Note that the number of the fixation members A may be increased or decreased as appropriate.

Figure 11:
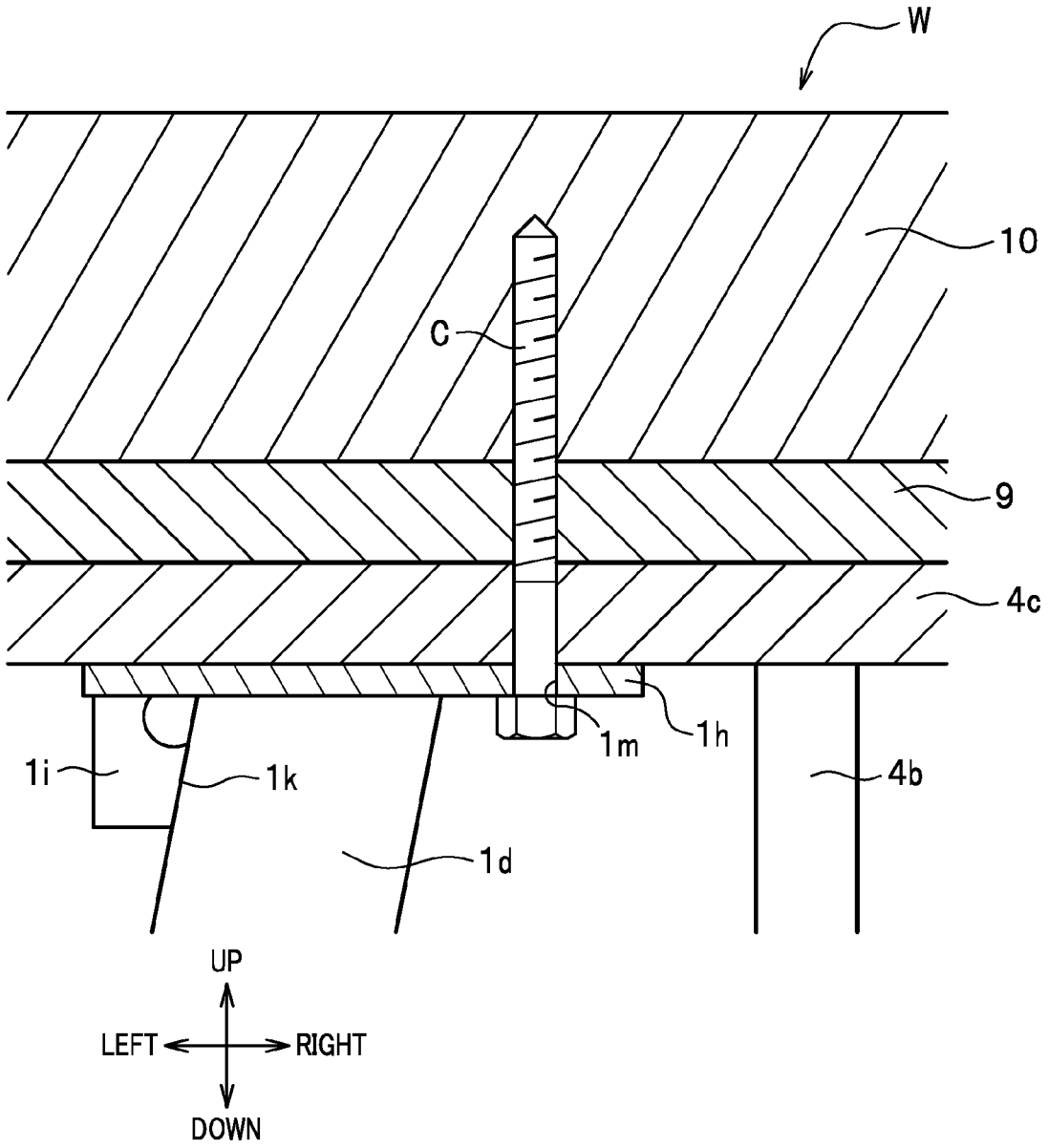
FIG. 11 is a partially enlarged cross-sectional view showing an upper structure of the load-bearing wall structure.

Next, an upper structure of the load-bearing wall structure W including the upper base plate 1*h* will be described in detail with reference to FIG. 11.

On an upper face of the upper frame 4*c*, the top plate 9 and the floor beam 10 are disposed sequentially in this order from below. The base plate 1*h* is disposed below the lower face of the upper frame 4*c*. An insertion hole 1*m* into which a coach screw bolt C is to be inserted is formed in the base plate 1*h*. The coach screw bolt C provided with threads on its outer peripheral face is inserted from below into the base plate 1*h*, the upper frame 4*c*, the top plate 9, and the floor beam 10. In other words, the base plate 1*h* is fixed to the upper frame 4*c*, the top plate 9, and the floor beam 10 by using the coach screw bolt C. Thus, the upper brace 1*d* is fixed to the upper frame 4*c*, the top plate 9, and the floor beam 10 via the base plate 1*h*. The top plate 9 and the floor beam 10 collectively correspond to a constructional material in a claim of the invention.

Figure 12:
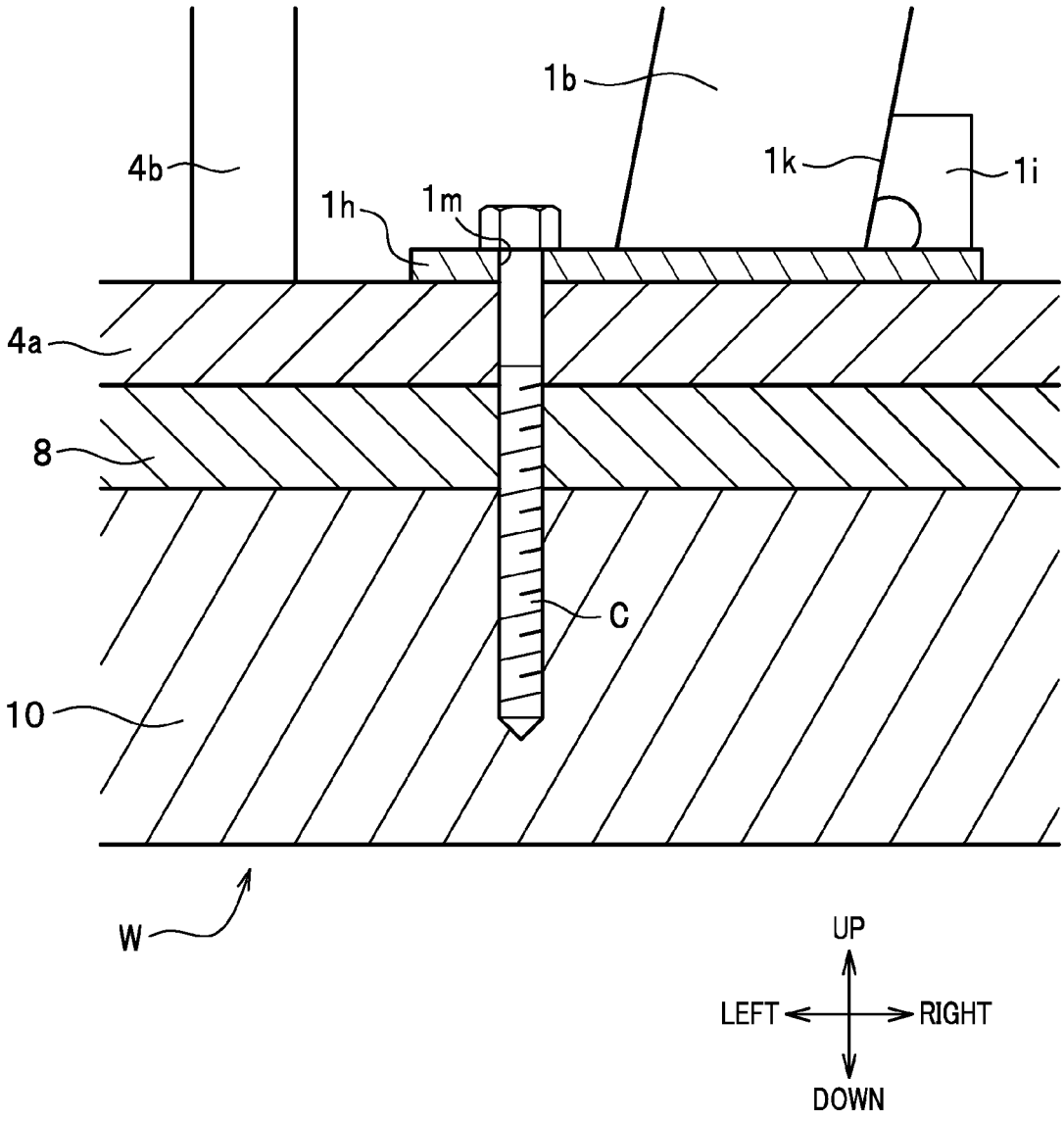
FIG. 12 is a partially enlarged cross-sectional view showing a lower structure of the load-bearing wall structure on an upper floor.

Next, a lower structure of the load-bearing wall structure W on an upper floor (such as a second floor) will be described in detail with reference to FIG. 12.

On a lower face of the lower frame 4*a*, the floor structure plywood plate 8 and the floor beam 10 are disposed sequentially in this order from above. The base plate 1*h* is disposed on the upper face of the lower frame 4*a*. An insertion hole 1*m* into which a coach screw bolt C is to be inserted is formed in the base plate 1*h*. The coach screw bolt C provided with threads on its outer peripheral face is inserted from above into the base plate 1*h*, the lower frame 4*a*, the floor structure plywood plate 8, and the floor beam 10. In other words, the base plate 1*h* is fixed to the lower frame 4*a*, the floor structure plywood plate 8, and the floor beam 10 by using the coach screw bolt C. Thus, the lower brace 1*b* is fixed to the lower frame 4*a*, the floor structure plywood plate 8, and the floor beam 10 via the base plate 1*h*. The floor structure plywood plate 8 and the floor beam 10 collectively correspond to the constructional material in the claim of the invention.

The load-bearing wall structure W according to the embodiment of the present invention is basically configured as described above. Next, the operation and effect thereof will be described.

According to the load-bearing wall structure W of this embodiment, the lower recess 21 is formed by cutting out the end on the central vertical frame 4*d* side of the lower brace 1*b*, and the upper recess 31 is formed by cutting out the end on the central vertical frame 4*d* side of the upper brace 1*d*. Thus, it is possible to bring the ends on the central vertical frame 4*d* side of the braces 1*b* and 1*d* closer to the central vertical frame 4*d* as compared to the brace of Patent Document 1 which has the constant cross-sectional dimensions throughout its length. In this way, each of the braces 1*b* and 1*d* can be arranged at a larger inclination angle with respect to the central vertical frame 4*d*. As a consequence, stability of each of the braces 1*b* and 1*d* is increased so that seismic force acting on the wall framework 4 can be reliably transmitted to the viscoelastic dampers 1*a*.

According to this embodiment, the lower connection member 1*c* is inserted into the lower slits 22 in the lower brace 1*b*, whereby interlock between the lower brace 1*b* and the lower connection member 1*c* is enhanced. Meanwhile, the upper connection member 1*e* is inserted into the upper slits 32 in the upper brace 1*d*, whereby interlock between the upper brace 1*d* and the upper connection member 1*e* is enhanced. As a consequence, the seismic force acting on the wall framework 4 can be smoothly transmitted from the braces 1*b* and 1*d* to the viscoelastic dampers 1*a* even in the case of providing the lower recesses 21 and the upper recesses 31.

According to this embodiment, the two sides in the wall width direction of the lower connection member 1*c* are held by the lower slits 22, whereby the interlock between the lower brace 1*b* and the lower connection member 1*c* is further enhanced. Meanwhile, the two sides in the wall width direction of the upper connection member 1*e* are held by the upper slits 32, whereby the interlock between the upper brace 1*d* and the upper connection member 1*e* is further enhanced. As a consequence, the seismic force can be smoothly transmitted from the braces 1*b* and 1*d* to the viscoelastic dampers 1*a*.

According to this embodiment, each of the braces 1*b* and 1*d* is formed into a flat hollow shape, which is longer in the wall width direction than in the wall thickness direction. This configuration enhances strength and rigidity of each of the braces 1*b* and 1*d* in the wall width direction which is the direction of action of the seismic force. As a consequence, the seismic force can be smoothly transmitted from the braces 1*b* and 1*d* to the viscoelastic dampers 1*a*.

According to this embodiment, there is provided the rib plate 1*i* to be connected to the central vertical frame 4*d* side of each lower brace 1*b*. Thus, the rib plate 1*i* can control an angular variation between the base plate 1*h* and the brace 1*b*, and the seismic force can be reliably transmitted to the viscoelastic dampers 1*a*. As a consequence, it is possible to increase an amount of shear deformation of each viscoelastic damper 1*a* and thus to increase an amount of absorption of the seismic force.

According to this embodiment, each upper base plate 1*h* is fixed to the upper frame 4*c*, the top plate 9, and the floor beam 10 by using the coach screw bolt C which is inserted from below. In this way, when the vibration damper device 1 is attached to a wall on a lower floor (such as a first floor), an operation to attach the base plates 1*h* to the upper frame 4*c* and the like can take place on the wall on the lower floor. As a consequence, the installation operation can be conducted without destroying the members on an upper floor (such as a second floor) side, and installation workability is thus enhanced.

According to this embodiment, each lower base plate 1*h* on the upper floor is fixed to the lower frame 4*a*, the floor structure plywood plate 8, and the floor beam 10 by using the coach screw bolt C which is inserted from above. In this way, when the vibration damper device 1 is attached to a wall on the upper floor (such as the second floor), an operation to attach the base plates 1*h* to the lower frame 4*a* and the like can take place on the wall on the upper floor. As a consequence, the installation operation can be conducted without destroying the members on the lower floor (such as the first floor) side, and installation workability is thus enhanced.

As a conventional installation method, there has been known a technique of fixing a constructional material and a base plate to a base by using an anchor bolt, of which a lower end side is buried in a base upright portion while an upper end side penetrates the constructional material such as a foundation and projects from a lower frame. However, since a main reinforcement is located at a relatively shallow position from an upper face of the base upright portion, the anchor bolt cannot be buried deep into the base upright portion at the time of renovation according to the conventional technique. Hence, it is not possible to secure a sufficient tensile strength of the anchor bolt. On the other hand, in this embodiment, the board plate P in the portal shape and provided with the anchor unit D is laid over the constructional material from above, and extends across the two sides of the base upright portion 51. Moreover, the board plate P and the base upright portion 51 are connected to each other by using the multiple fixation members A to be driven in from the side of the base upright portion 51. For this reason, it is possible to drive in the fixation members A at the time of renovation while avoiding interference with the main reinforcement. Thus, it is possible to counter the tensile force with a shear capacity of the fixation members A. In addition, it is also possible to increase the shear capacity by increasing the number of the fixation members A. Meanwhile, when the anchor bolt according to the conventional technique is disposed at the time of renovation, it is necessary to partially cut out the constructional material such as the foundation so as to expose the upper surface of the base upright portion 51, whereby the installation operation is complicated. On the other hand, in this embodiment, it is only necessary to put the board plate P in the portal shape and provided with the anchor unit D on the constructional material from above. Accordingly, this configuration suppresses the cutting work on the constructional material and facilitates the installation operation.

While the preferred embodiment of the present invention has been described with reference to the drawings, the present invention is not limited to this embodiment, and can be appropriately changed within the scope not departing from the gist of the invention. The embodiment describes the case of applying the load-bearing wall structure W of the present invention to the wood building constructed in accordance with the framing method. However, the present invention is not limited to this configuration. For instance, the present invention is also applicable to a case of a building constructed in accordance with a timber framework method, a steel construction method, and the like. Here, the number of floors is not limited to a specific number either.

In the embodiment, each of the braces 1*b* and 1*d* is formed into the flat hollow shape which is longer in the wall width direction than in the wall thickness direction. Instead, each brace may be formed into a flat hollow shape which is longer in the wall thickness direction than in the wall width direction, or into a square shape.

In the embodiment, the rib plate 1*i* is provided separately from the base plate 1*h*. However, the rib plate 1*i* and the base plate 1*h* may be formed integrally with each other.

In the embodiment, the board plate P in the portal shape and provided with the anchor unit D is used as the means for fixing the constructional material and the base plate 1*h* to the base 5. Instead, it is possible to use the publicly known conventional anchor bolt, of which the lower end side is buried in the base upright portion 51 while the upper end side penetrates the constructional material and projects from the lower frame 5*a*.

What is claimed is:

1. A vibration damper device to be disposed in a wall framework including a lower frame, a pair of end vertical frames erected on ends of the lower frame, an upper frame laid across upper ends of the pair of end vertical frames, and a central vertical frame disposed between the pair of end vertical frames and extending from the lower frame to the upper frame, the vibration damper device comprising:

a pair of viscoelastic dampers arranged while sandwiching the central vertical frame;

a pair of lower braces supporting the viscoelastic dampers from below, and being inclined to come closer to the central vertical frame while extending toward the viscoelastic dampers;

a pair of upper braces supporting the viscoelastic dampers from above, and being inclined to come closer to the central vertical frame while extending toward the viscoelastic dampers;

a plurality of connection members connecting the viscoelastic dampers to the lower braces and to the upper braces; and a joining member inserted into a through-hole penetrating the central vertical frame in a wall width direction, and configured to join the pair of viscoelastic dampers, wherein each of the lower braces and the upper braces includes a recess formed at an end on the central vertical frame side of the brace so as to avoid interference with the central vertical frame, wherein the recess is straight and parallel to the central vertical frame and a slit into which the corresponding connection member is inserted.

2. The vibration damper device according to claim 1, wherein each of the lower braces and the upper braces is formed into a hollow shape including a pair of side walls opposed to each other in the wall width direction, and the slit is formed in each of the side walls, and holds two sides in the wall width direction of the connection member.

3. The vibration damper device according to claim 1, wherein each of the lower braces and the upper braces is formed into a flat hollow shape which is longer in the wall width direction than in a wall thickness direction.

4. The vibration damper device according to claim 1, comprising:

base plates interposed between the lower frame and the lower braces and between the upper frame and the upper braces; and connection members each of which extends upward or downward from the corresponding base plate, and is connected to the central vertical frame side of the corresponding one of the lower braces and the upper braces, wherein the base plates are directly connected to a lower end of the corresponding lower brace or to an upper end of the corresponding upper brace, and the connection members are in contact with the central vertical frame side of the corresponding one of the lower braces and upper braces.

5. A load-bearing wall structure comprising:

the vibration damper device according to claim 4; and a constructional material disposed above the upper frame or below the lower frame, wherein each of the base plates is fixed to the constructional material and to the upper frame or the lower frame by using a coach screw bolt inserted from below the upper frame or from above the lower frame.

6. A load-bearing wall structure comprising:

the vibration damper device according to claim 1;

a base including a base upright portion;

a lower constructional material disposed on an upper face of the base upright portion;

a board plate laid over the lower constructional material from above, and extending across two sides of the base upright portion; and the lower frame disposed above the lower constructional material and the board plate, wherein the base upright portion and the board plate are connected to each other by a fixation member driven in from a lateral side of the base upright portion, and an anchor unit vertically penetrating the lower frame is provided on an upper wall of the board plate.

7. A load-bearing wall structure comprising:

a vibration damper device comprising:

a pair of viscoelastic dampers arranged while sandwiching the central vertical frame;

a pair of lower braces supporting the viscoelastic dampers from below, and being inclined to come closer to the central vertical frame while extending toward the viscoelastic dampers;

a pair of upper braces supporting the viscoelastic dampers from above, and being inclined to come closer to the central vertical frame while extending toward the viscoelastic dampers;

a plurality of connection members connecting the viscoelastic dampers to the lower braces and to the upper braces; and a joining member inserted into a through-hole penetrating the central vertical frame in a wall width direction, and configured to join the pair of viscoelastic dampers, wherein each of the lower braces and the upper braces includes a recess formed at an end on the central vertical frame side of the brace so as to avoid interference with the central vertical frame, and a slit into which the corresponding connection member is inserted;

a base including a base upright portion;

a lower constructional material disposed on an upper face of the base upright portion;

a board plate laid over the lower constructional material from above, and extending across two sides of the base upright portion; and the lower frame disposed above the lower constructional material and the board plate, wherein the base upright portion and the board plate are connected to each other by a fixation member driven in from a lateral side of the base upright portion, and an anchor unit vertically penetrating the lower frame is provided on an upper wall of the board plate.

* * * * *